US006415935B1

(12) United States Patent
Hins

(10) Patent No.: US 6,415,935 B1
(45) Date of Patent: Jul. 9, 2002

(54) MULTIPLE-THREAD SCREW THREAD ARRANGEMENT WITH DIVERSE THREAD TURN RUNOUT ARRANGEMENT

(75) Inventor: Johannes Hins, Sundern (DE)

(73) Assignee: Georg Menshen GmbH & Co. KG, Finnentrop (DE)

( * ) Notice: Subject to any disclaimer, the term of this patent is extended or adjusted under 35 U.S.C. 154(b) by 0 days.

(21) Appl. No.: 09/452,152

(22) Filed: Dec. 1, 1999

Related U.S. Application Data

(63) Continuation of application No. PCT/EP99/02678, filed on Apr. 21, 1999.

(30) Foreign Application Priority Data

Apr. 29, 1998 (DE) ..... 298 07 759 U

(51) Int. Cl.[7] ..... B65D 41/04

(52) U.S. Cl. ..... 215/329; 215/44; 215/321; 280/288; 285/333

(58) Field of Search ..... 215/329, 321, 215/44, 330, 318; 220/296, 288; 285/333, 334, 390, 335, 914; 411/413, 412, 386

(56) References Cited

U.S. PATENT DOCUMENTS

| | | | | | |
|---|---|---|---|---|---|
| 859,643 | A | * | 7/1907 | Cummings | |
| 1,621,487 | A | * | 3/1927 | Aulbach | |
| 1,866,770 | A | * | 1/1932 | Hilgenberg | 215/44 |
| 2,589,005 | A | * | 3/1952 | Welhart | |
| 3,581,926 | A | * | 6/1971 | Roder | 215/330 |
| 3,730,016 | A | * | 5/1973 | Miller | |
| 3,822,027 | A | * | 7/1974 | Cherba | |
| 3,828,962 | A | * | 8/1974 | Atkins | 215/321 |
| 4,081,098 | A | * | 3/1978 | Johansson | 215/329 |
| 4,346,920 | A | * | 8/1982 | Dailey | |
| 4,461,394 | A | * | 7/1984 | Sendel et al. | 215/330 |
| 4,770,308 | A | * | 9/1988 | Lynn | 215/330 |
| 4,948,001 | A | * | 8/1990 | Magly | 215/329 X |
| 5,169,033 | A | * | 12/1992 | Shay | 215/330 X |
| 5,184,741 | A | * | 2/1993 | Chevassus et al. | 215/329 X |
| 5,213,224 | A | * | 5/1993 | Luch | 215/329 X |
| 5,307,946 | A | * | 5/1994 | Molinaro | 220/288 X |
| 5,494,174 | A | | 2/1996 | Rohr et al. | |
| 5,533,633 | A | * | 7/1996 | King | 215/330 X |
| 5,553,727 | A | * | 9/1996 | Molinaro | 215/318 X |
| 5,702,014 | A | * | 12/1997 | Nielsen | 215/44 X |
| 6,006,930 | A | * | 12/1999 | Dreyer et al. | 220/288 X |

FOREIGN PATENT DOCUMENTS

| | | | | |
|---|---|---|---|---|
| CA | 607831 | * | 11/1960 | 215/329 |
| CA | 1117479 | * | 2/1982 | 215/329 |
| DE | 3003280 | * | 8/1981 | |
| DE | 36 04 768 A1 | | 8/1986 | |
| DE | 39 13 299 A1 | | 10/1990 | |
| EP | 0 494 651 A1 | | 7/1992 | |
| FR | 1055024 | * | 2/1954 | 215/329 |
| FR | 2618129 | * | 1/1989 | 215/329 |
| GB | 704886 | * | 3/1954 | 215/329 |
| JP | 09170615 A | | 6/1997 | |

* cited by examiner

*Primary Examiner*—Lee Young
*Assistant Examiner*—Robin A. Hylton
(74) *Attorney, Agent, or Firm*—Birch, Stewart, Kolasch & Birch

(57) ABSTRACT

In a screw thread arrangement for the angular positioning, in the circumferential direction, of a first component having a multiple-thread pattern screw thread relative to a second component having a complementary multiple-thread screw thread pattern, in particular for a threaded closure cap relative to a container member, wherein a first angular spacing of adjacent runouts when viewed in a circumferential direction differs from angular spacing of adjacent runouts . As an alternative the dimensions of at least one thread turn of each multiple-thread screw thread pattern is different from those of a second thread turn. By such measures, when configurations of the components are rotationally asymmetrical, the two parts are always positively brought into alignment when the one component has been firmly screwed onto the other.

6 Claims, 2 Drawing Sheets

MULTIPLE-THREAD SCREW THREAD ARRANGEMENT WITH DIVERSE THREAD TURN RUNOUT ARRANGEMENT

This application is a continuation of U.S. application Ser. No. PCT/EP99/02678, filed Apr. 21, 1999.

BACKGROUND OF THE INVENTION

The invention relates to a multiple-thread screw thread arrangement for angular positioning, in the circumferential direction, of a first component having a multiple-thread screw thread pattern relative to a second component having a complementary multiple-thread screw thread pattern, and more particularly, of a threaded closure cap relative to a container member.

For various reasons, it is frequently desirable, especially in the packaging industry, to make a container for storing e.g. cosmetic products, rotationally If asymmetric by making e.g. one portion of a peripheral wall of the container flat, while a remaining peripheral portion may be circular or oval or designed in some other way. If a corresponding, rotationally asymmetric closure cap is to be placed on such a container, as is frequently desired so as to provide a complete combination of container and cap with an aesthetically pleasing appearance, it has to be ensured that the closure cap is always aligned in a specific manner relative to the container when in the closed position; otherwise, parts thereof might project out relative to the container and thus would not only detract from the external appearance of the combination but could also cause difficulties when transporting and storing it. Moreover, an advertising slogan extending across the two parts of the combination might be interrupted thereby. In the case of closure caps that are attached to the container by axial snap-on, the desired alignment can be obtained comparatively easily by providing the two parts with features that only permit snap-on when the cap has a particular angular alignment relative to the container. Naturally however, such a solution to the problem is not suitable for threaded closure caps. In contrast to snap-on, the fixing of a closure cap to a container by screwing it on has the advantage that this allows a more user-friendly and less forceful operation.

It is an object of the invention to provide, in a rotationally asymmetric combination of a first component and a second component in which the first component can be screwed onto the second component, a combination in which the first component always comes to rest at a particular angular alignment relative to the second component when it is in a fully screwed position relative to the first component. It is a further object of the invention to provide, in a rotationally asymmetric combination of a first component and a second component in which the first component can be screwed onto the second component, a combination in which a predetermined angular alignment of the first component relative to the second component in a fully screwed position thereof can be obtained without requiring special care in handling the first component while it is being screwed on.

SUMMARY OF THE INVENTION

In accordance with one aspect of the invention, these and other objects are achieved by a screw thread arrangement for the angular positioning, in the circumferential direction, of a first component having a multiple-thread screw thread pattern relative to a second component having a complementary multiple-thread screw thread pattern, in particular of a threaded closure cap relative to a container member, in which thread runouts (thread runouts being outer-end portions of thread turns which first engage thread turns of the complementary component) of the multiple-thread screw thread patterns of each component are angularly spaced from each other in the circumferential direction, wherein, a first angular spacing between positions of adjacent turn runouts when viewed in a circumferential direction differs from a second angular spacing between positions of adjacent thread runouts.

In accordance with an alternative aspect of the invention a screw thread arrangement for the angular positioning, in the circumferential direction, of a first component having a multiple-thread screw thread pattern relative to a second component having a complementary multiple-thread screw thread pattern, in particular of a threaded closure cap relative to a container member, is provided in which the thread runouts of the multiple-thread screw thread patterns of each component are angularly spaced from each other in the circumferential direction, wherein a dimension of at least one thread turn of each multiple-thread screw thread pattern is different from that of other thread turns When a threaded closure cap provided with a screw thread arrangement according to the invention is to be screwed onto a container member, a particular angular mutual alignment of the two parts is initially required so as to bring the co-operating turns of the threads on the cap and the container member into mutual alignment and thereby allow them to be screwed onto one another. In other words: the cap cannot be screwed on at any arbitrary angular alignment thereof relative to the container member. This does not require careful handling on the part of the user however, since the alignment is automatically set or made perceptible by an initial, tentative rotation of the closure cap. Consequently, by appropriate dimensioning of the screw path, it can be achieved that the closure cap always adopts a particular position relative to the container member when it is in its fully screwed-on state. The external appearance of a combination of a closure cap and a container having congruent rotationally asymmetric shapes is thereby free of projections and allows advertising slogans to be placed on e.g. flat overlapping peripheral portions of the two parts.

The invention both as to its construction and its method of operation, together with additional objects and advantages thereof, will be best understood from the following description of specific embodiments when read in connection with the accompanying drawing

DESCRIPTION OF THE PREFERRED EMBODIMENTS

Although the invention is described hereinafter in connection with its use with containers, bottles and other vessels for accommodating fluid, pasty or pourable products e.g. cleaning materials, cosmetic preparations or the like, it should be understood that it is not limited to such fields of application. Rather, it can always be used to advantage when it is necessary to bring two components that are adapted to be screwed together into a particular angular alignment before the screwing operation can be continued. In the case of components made of synthetic material to be screwed together, the multiple-thread screw thread arrangement in accordance with the invention can be implemented particularly advantageously during the manufacture thereof by injection moulding.

Figure 1B:
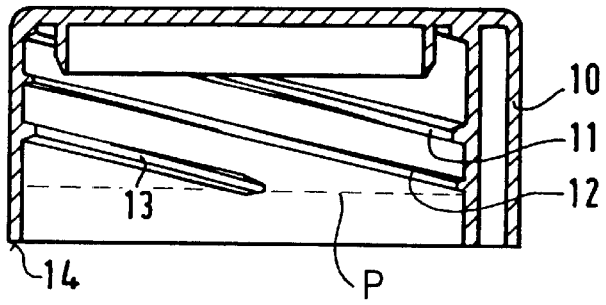
FIGS. 1A–1C, taken together, form a fragmentary, partially sectional exploded view of a combination of a container member and a threaded closure cap having a screw thread arrangement in accordance with a first embodiment of the invention, with FIG. 1A being a side view of the container member from the front, FIG. 1B depicting the threaded closure cap in a longitudinal sectional view, and FIG. 1C being a top view of the container member.
Figure 1A:
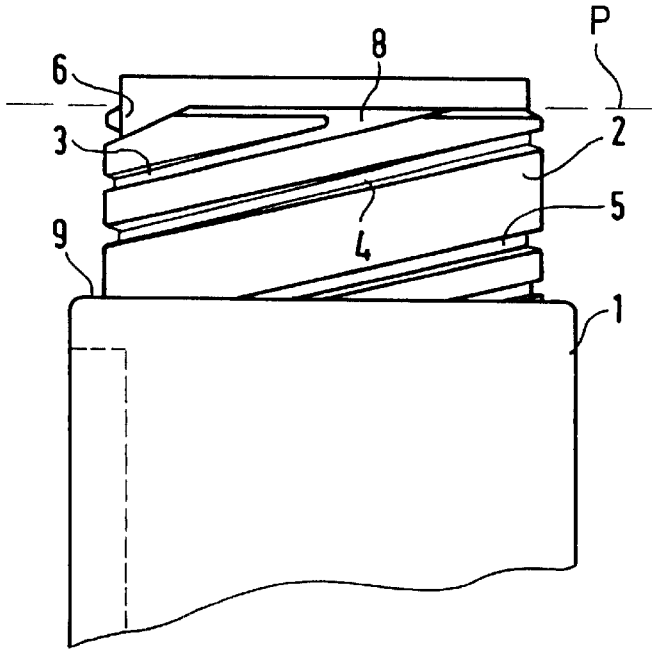
Figure 1C:
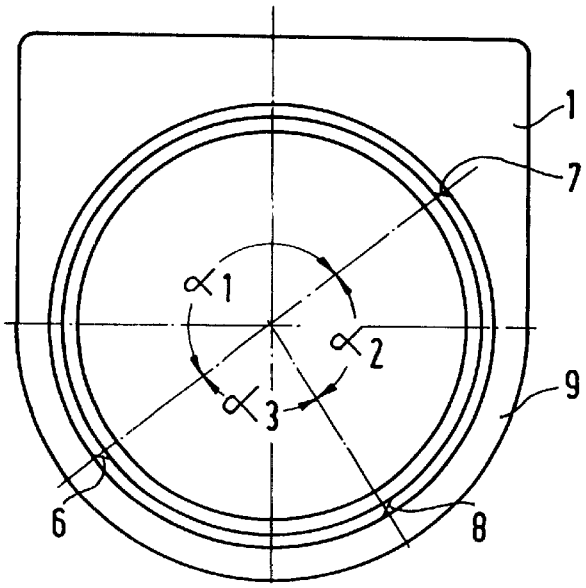

Reference will be made hereinafter to the embodiment of the invention according to FIGS. 1A–1C. In FIG. 1A, there is shown a container member 1 having a rotationally asymmetric that it is circular around one portion of its periphery and rectangular along an adjoining peripheral portion as can be seen from FIG. 1C. A tubular neck portion 2 is formed at one axial end of the container member 1, said neck portion 2 supporting on its outer periphery a multiple-thread screw thread pattern comprised of three thread turns 3, 4 and 5 (shown as trough thread turns in the drawings), which are of similar pitch and dimension in the present embodiment.

The multiple-thread screw thread pattern of the container member 1 can cooperate with a complementary multiple-thread screw thread pattern on a closure cap 10 having thread turns 11, 12, 13 (shown as rib thread turns in the drawings) that are complementary to the trough thread turns 3, 4 and 5 of the container member 1, in order to allow the threaded closure cap 10 to be screwed onto the neck portion 2 of the container member 1 until a lower free end face 14 of the closure cap 10 comes to rest on a shoulder face 9 of the container member 1, which may be provided along the outer periphery of the neck portion 2 or directly on the container member.

In its end position, the closure cap 10 has a particular angular alignment relative to the container member due to the measures in accordance with the invention. Consequently, like the container member 1, the threaded closure cap 10 may have a rotationally asymmetric configuration (not shown) e.g. a rectangular shaping similar to the rectangular peripheral portion of the container member 1 may be provided on the outer periphery of the threaded closure cap 10, it being desired hereby, that the rectangular portions of the container member 1 and the threaded closure cap 10 be in mutual alignment in the end position thereof. In accordance with the invention, this is achieved by not distributing respective runouts (outer-most end portions which first engage) 6, 7, 8 of the trough thread turns 3, 4, 5 of the container member 1 and the runouts (not shown) of the complementary rib thread turns 11, 12, 13 (only one runout can be seen in FIG. 1B) of the threaded closure cap 10 uniformly around the periphery of the neck portion 2 and the threaded closure cap 10, the runouts being located in a common radial plane P, but by arranging them such that, when viewed in a circumferential direction, the pair of adjacent runouts 6, 7 have an angular spacing a, that differs from the angular spacings $\alpha_2$ and $\alpha_3$ of the pairs of other adjacent runouts 7, 8 and 8, 6 respectively. In the present embodiment, $\alpha_1$ is equal to 180°, while the angular spacings $\alpha_2$ and $\alpha_3$ each are 90°.

The runouts of the rib thread turns 11,12, 13 of the threaded closure cap 10 are arranged in a corresponding manner. Consequently, the threaded closure cap 10 can only be screwed onto the neck portion 2 of the container member 1 when the runouts of the co-operating thread turns 3, 4, 5 and 11, 12, 13 have been brought into angular alignment beforehand. The wanted alignment of the two parts is automatically effected when the axial thread length of the multiple-thread screw thread of the neck portion 2 up to the position in which the threaded closure cap 10 is in the end position is appropriately dimensioned.

In the previously described embodiment of the invention, three thread turns are provided on the container neck portion 2 and the threaded closure cap 10 respectively, although there is no fundamental necessity for all of these turns. Instead of a three-thread or multiple-thread screw thread pattern, a two-thread screw thread pattern could also be provided, provided the runouts thereof do not have a symmetrical angular spacing. Thus, for example, the angular spacing when viewed in one circumferential direction could be 270° while being 90° in the opposite circumferential direction.

Figure 2B:
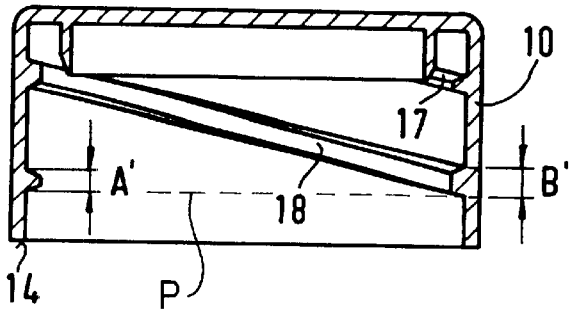
FIGS. 2A–2C, are views similar to FIGS. 1A–1C which, taken together, form a combination of a container member and a threaded closure cap having a screw thread arrangement in accordance with a second embodiment of the invention in views similar to those of FIGS. 1A–1C.
Figure 2A:
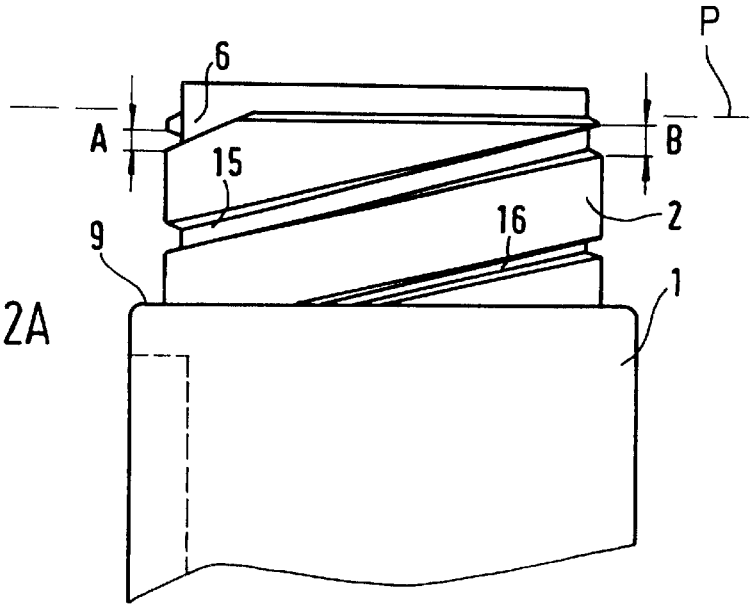
Figure 2C:
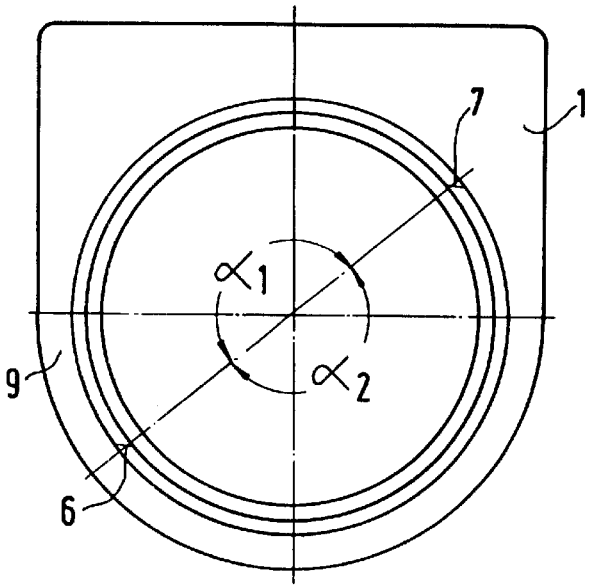

The second embodiment of the invention will be explained hereinafter with reference to FIGS. 2A–2C. Same or similar parts in FIGS. 2A–2C bear the same reference numbers as were used in the first embodiment described in connection with FIGS. 1A–1C. A repeated description of these parts can therefore be dispensed with. In the second embodiment of the invention, a two-thread screw thread is provided on the neck portion 2 of the container member 1 and on the closure cap 10 respectively. The trough thread turns of the neck portion 2 bear the reference numbers 15, 16 while the rib thread turns of the closure cap 10 bear the reference numbers 17, 18. The runouts 6, 7 of the thread turns 15, 16 of the container neck portion 2—and likewise the thread turns of the complementary screw thread pattern of the closure cap 10—are arranged symmetrically as is shown in FIG. 2C in that the runouts 6, 7 have an angular spacing of $\alpha_1=\alpha_2=180°$.

The prerequisite of a particular angular alignment of the closure cap 10 in relation to the container neck portion 2 so as to allow the closure cap 10 to be screwed on is achieved by making the respective widths A, A' and B, B' of the thread turns 15, 16 of the neck portion 2 and the thread turns 17, 18 of the threaded closure cap 10 different, although they have the same pitch. Thus for example, the ratios B:A and B':A' could be 3:2. In consequence, only those thread turns 15, 18 and 16, 17 of the container neck portion 2 and the threaded closure cap 10 having a matching width can be brought into engagement with each other at the common plane P, this requiring a particular angular alignment of the threaded closure cap 10 relative to the container neck portion 2 so that effects similar to those of the first embodiment are obtained. As can be seen in FIG. 2B, the widths of the two threads are different at the runouts.

If so desired, a screw thread arrangement could also be provided on the container neck portion and the threaded closure cap which is a combination of the first and second embodiments of the invention. Other variations and modifications of the invention which become apparent to an expert from the foregoing description of the invention may be effected without departing from the true spirit and scope of the principles of this invention.

What is claimed is:

1. A screw thread arrangement for angularly positioning, in a circumferential direction, a first component laving a multiple-thread screw thread pattern relative to a second component having a complementary multiple-thread screw thread pattern, wherein positions of runouts of thread turns of the multiple threads of each component are substantially positioned in a single radial plane and are angularly spaced from each other in the circumferential direction, with one angular spacing between positions of adjacent runouts, when viewed in a circumferential direction, differing from another spacing between positions of adjacent runouts.

2. The screw thread arrangement of claim 1, wherein, for a number "n" of threads for each multiple-thread screw thread pattern of each component, the angular spacing between positions of at least two adjacent runouts is not equal to 360°/n.

3. The screw thread arrangement of claim 1, wherein for each component a first angular spacing between positions of adjacent runouts is 180° and a second angular spacing between positions of adjacent runouts is significantly less than 180°.

4. A screw thread arrangement for angularly positioning, in the circumferential direction, a first component having a multiple-thread screw thread pattern relative to a second component having a complementary multiple-thread screw thread pattern, wherein positions of runouts of thread turns of the multiple threads of each component are substantially positioned in a single plane and are angularly spaced from each other in the circumferential direction, and wherein a dimension of at least one thread turn at the runout of each multiple-thread screw thread pattern of each component is different from a same dimension of another thread turn of the same multiple-thread screw thread pattern.

5. The screw thread arrangement of claim 4 wherein said one thread turn of each component has a smaller width than does the other thread turn.

6. The screw thread arrangement of claim 4 wherein angular spacings between positions of adjacent runouts of the tread turns of each multiple-thread screw thread pattern is equal.

* * * * *